US009465309B2

(12) United States Patent
Kobayashi

(10) Patent No.: US 9,465,309 B2
(45) Date of Patent: Oct. 11, 2016

(54) ELECTROSTATIC LATENT IMAGE DEVELOPING TONER

(71) Applicant: KYOCERA Document Solutions Inc., Osaka (JP)

(72) Inventor: Ryota Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/643,426

(22) Filed: Mar. 10, 2015

(65) Prior Publication Data

US 2015/0261112 A1 Sep. 17, 2015

(30) Foreign Application Priority Data

Mar. 13, 2014 (JP) ..... 2014-049989

(51) Int. Cl.
*G03G 9/097* (2006.01)
*G03G 9/093* (2006.01)

(52) U.S. Cl.
CPC ..... *G03G 9/09328* (2013.01); *G03G 9/09385* (2013.01); *G03G 9/09392* (2013.01); *G03G 9/09725* (2013.01); *G03G 9/09741* (2013.01)

(58) Field of Classification Search
CPC ..... G03G 9/09307; G03G 9/09741; G03G 9/09725
USPC ..... 430/108.22, 110.2
See application file for complete search history.

(56) References Cited

U.S. PATENT DOCUMENTS

| | | | | | |
|---|---|---|---|---|---|
| 5,104,763 | A * | 4/1992 | Ong | G03G 9/09328 | 428/402.24 |
| 6,342,328 | B1 * | 1/2002 | Takasaki | G03G 9/08726 | 430/108.22 |
| 9,329,513 | B2 * | 5/2016 | Kobayashi | G03G 9/09725 | |
| 2003/0027070 | A1 * | 2/2003 | Niwa | G03G 9/08704 | 430/108.22 |
| 2010/0173240 | A1 * | 7/2010 | Sensui | G03G 9/0827 | 430/108.2 |
| 2014/0170549 | A1 * | 6/2014 | Tsunemi | G03G 9/097 | 430/108.1 |

FOREIGN PATENT DOCUMENTS

| | | | | |
|---|---|---|---|---|
| JP | 2626271 | B2 * | 7/1997 | |
| JP | 2002148846 | A * | 5/2002 | |
| JP | 2005202132 | A * | 7/2005 | |
| JP | 2005-321690 | A | 11/2005 | |
| WO | WO 2013027397 | A1 * | 2/2013 | G03G 9/097 |

OTHER PUBLICATIONS

English language machine translation of JP 2002-148846 (May 2002).*
English language machine translation of JP 2005-202132 (Jul. 2005).*
English language machine translation of JP 2626271 (Jul. 1997).*

* cited by examiner

*Primary Examiner* — Christopher Rodee
(74) *Attorney, Agent, or Firm* — Studebaker & Brackett PC

(57) ABSTRACT

An electrostatic latent image developing toner includes a plurality of toner particles. Each of the toner particles includes a toner mother particle and an external additive. The external additive includes cores and coating layers that are each disposed over a surface of a corresponding one of the cores. The cores contain silica. The coating layers contain a nitrogen-containing resin and a water-soluble positive charge control agent. The nitrogen-containing resin is a thermosetting resin.

4 Claims, 1 Drawing Sheet

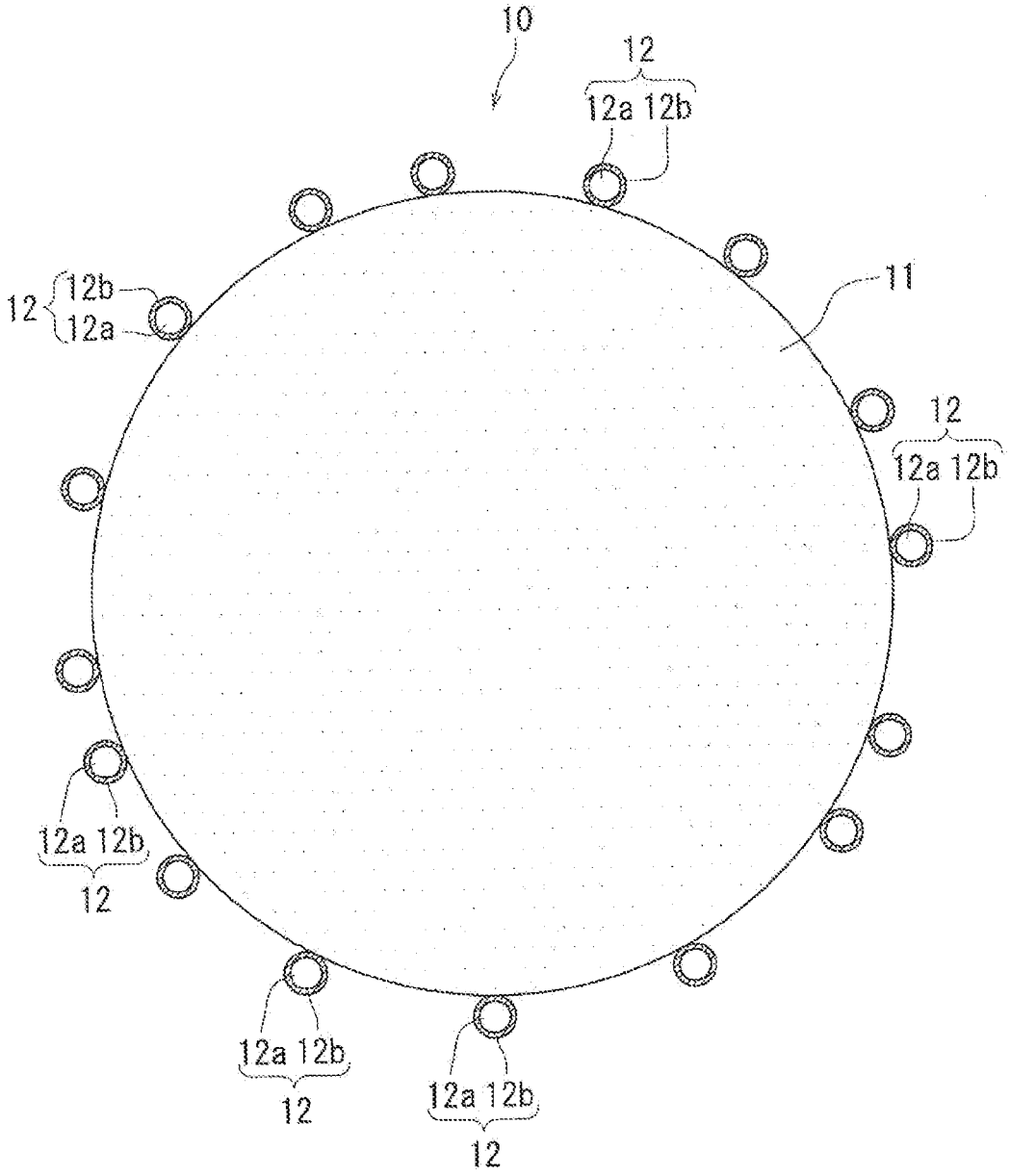
10
12
12a 12b
11
12
12b
12a
12
12a 12b
12a 12b
12
12a 12b
12
12a 12b
12

ELECTROSTATIC LATENT IMAGE DEVELOPING TONER

INCORPORATION BY REFERENCE

The present application claims priority under 35 U.S.C. §119 to Japanese Patent Application No. 2014-049989, filed Mar. 13, 2014. The contents of this application are incorporated herein by reference in their entirety.

BACKGROUND

The present disclosure relates to an electrostatic latent image developing toner.

In electrophotography, an electrostatic latent image is typically formed on the surface of a photosensitive drum by exposing the surface of the photosensitive drum to light while in a charged state. The electrostatic latent image is subsequently developed using a toner to form a toner image on the surface of the photosensitive drum. The toner image is subsequently transferred onto a recording medium, thereby forming an image on the recording medium.

An electrostatic latent image developing toner includes a plurality of toner particles. The toner particles are prepared through a mixing process of mixing components such as a binder resin, a colorant, a charge control agent, a releasing agent, and a magnetic powder, a kneading process of kneading the resultant mixture, a pulverizing process of pulverizing the resultant kneaded mixture, and a classifying process of classifying the resultant pulverized product.

The electrostatic latent image developing toner develops an electrostatic latent image on a photosensitive member through electrostatic force resulting from triboelectric charging of the toner. In general, excessive charging of the toner tends to occur when printing is performed successively on a large number of sheets, leading to reduced image density.

An external additive may be caused to adhere to the surface of the toner particles in order to improve properties of the toner in terms of fluidity, charging stability, and ease of cleaning residual toner that has not been transferred from the photosensitive member. Examples of substances that can be used as the external additive include particles of inorganic materials such as silica and titanium oxide.

Particles of inorganic materials, such as silica, that can be used as the external additive tend to include silanol groups and as a consequence tend to be hydrophilic and negatively chargeable. Therefore, when particles of an inorganic material such as described above are to be used as the external additive, the surface of the external additive particles is treated using a surface treatment agent in order to make the surface of the toner particles positively chargeable. Examples of surface treatment agents that can be used include silane coupling agents and silicone oil.

SUMMARY

An electrostatic latent image developing toner according to the present disclosure includes a plurality of toner particles. Each of the toner particles includes a toner mother particle and an external additive. The external additive includes cores and coating layers that are each disposed over a surface of a corresponding one of the cores. The cores contain silica. The coating layers contain a nitrogen-containing resin and a water-soluble positive charge control agent. The nitrogen-containing resin is a thermosetting resin.

BRIEF DESCRIPTION OF THE DRAWINGS

The FIGURE illustrates a toner particle according to an embodiment.

DETAILED DESCRIPTION

The following explains an embodiment of the present disclosure. The present disclosure is not in any way limited by the following embodiment and appropriate changes may be made when practicing the present disclosure so long as such changes do not deviate from the intended scope of the present disclosure. Note that explanation is omitted where appropriate in order to avoid repetition but such omission does not limit the present disclosure.

The following explains composition of an electrostatic latent image developing toner according to the present embodiment with reference to the FIGURE. The toner according to the present embodiment includes a plurality of toner particles 5 10. Each of the toner particles 10 includes a toner mother particle 11 and an external additive 12. The toner according to the present embodiment can be used in an electrophotographic apparatus.

<Toner Mother Particles>

The toner mother particles 11 preferably contain a binder resin. The toner mother particles 11 may further contain, in addition to the binder resin, optional components such as a colorant, a charge control agent, a releasing agent, and a magnetic powder. Shell layers may be disposed over the surface of the toner mother particles 11. The following explains components contained in the toner mother particles 11.

(Binder Resin)

No particular limitation is placed on the binder resin contained in the toner mother particles 11, other than being a binder resin for use in a toner. Examples of the binder resin include thermoplastic resins such as styrene-based resins, acrylic-based resins, styrene-acrylic-based resins, polyethylene-based resins, polypropylene-based resins, vinyl chloride-based resins, polyester resins, polyamide resins, urethane resins, polyvinyl alcohol-based resins, vinyl ether-based resins, N-vinyl-based resins, and styrene-butadiene resins. Among the thermoplastic resins listed above, styrene-acrylic-based resins and polyester resins are preferable due to having favorable properties in terms of colorant dispersibility in the toner, toner chargeability, and fixability of the toner on paper. The following explains styrene-acrylic-based resins and polyester resins.

A styrene-acrylic-based resin is a copolymer of a styrene-based monomer and an acrylic-based monomer. Examples of the styrene-based monomer include styrene, α-methylstyrene, vinyltoluene, α-chlorostyrene, o-chlorostyrene, m-chlorostyrene, p-chlorostyrene, and p-ethylstyrene. Examples of the acrylic-based monomer include alkyl(meth)acrylates such as methyl(meth)acrylate, ethyl(meth)acrylate, n-propyl(meth)acrylate, iso-propyl(meth)acrylate, n-butyl(meth)acrylate, iso-butyl(meth)acrylate, and 2-ethylhexyl acrylate. Note that the term "(meth)acryl" is used as a generic term for both acryl and methacryl.

A polyester resin that is synthesized through polymerization of a di-, tri-, or higher-hydric alcohol with a di-, tri-, or higher-basic carboxylic acid can be used. Examples of components that can be used in synthesis of the polyester resin include the following di-, tri-, or higher-hydric alcohols and di-, tri-, or higher-basic carboxylic acids.

Examples of di-hydric alcohols that can be used include diols (for example, ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol) and bisphenols (for example, bisphenol A, hydrogenated bisphenol A, polyoxyethylenated bisphenol A, and polyoxypropylenated bisphenol A).

Examples of tri- or higher-hydric alcohols that can be used include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of di-basic carboxylic acids that can be used include maleic acid, fumaric acid, citraconic acid, itaconic acid, glutaconic acid, phthalic acid, isophthalic acid, terephthalic acid, cyclohexanedicarboxylic acid, succinic acid, alkyl succinic acids (specifically, n-butylsuccinic acid, isobutylsuccinic acid, n-octylsuccinic acid, n-dodecylsuccinic acid, and isododecylsuccinic acid), alkenyl succinic acids (specifically, n-butenylsuccinic acid, isobutenylsuccinic acid, n-octenylsuccinic acid, n-dodecenylsuccinic acid, and isododecenylsuccinic acid), adipic acid, sebacic acid, azelaic acid, and malonic acid.

Examples of tri- or higher-basic carboxylic acids that can be used include 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid. Instead of any of the di-, tri- or higher-basic carboxylic acids listed above, an ester-forming derivative thereof may be used such as an acid halide, an acid anhydride, or a lower alkyl ester. The term "lower alkyl" refers to an alkyl group having from one to six carbon atoms.

No particular limitation is placed on the softening point (Tm) of the binder resin but in general it is preferable that the softening point (Tm) is at least 60° C. and no greater than 100° C., and more preferable that the softening point (Tm) is at least 70° C. and no greater than 95° C.

The binder resin preferably has a glass transition point (Tg) of at least 50° C. and no greater than 65° C., and more preferably at least 50° C. and no greater than 60° C.

(Releasing Agent)

The toner mother particles 11 may optionally contain a releasing agent in accordance with necessity thereof. The releasing agent is typically used in order to improve low-temperature fixability and offset resistance of the toner. No particular limitation is placed on the type of releasing agent that is used other than being a known releasing agent for use in a toner.

Preferable examples of the releasing agent include aliphatic hydrocarbon-based waxes (for example, low molecular weight polyethylene, low molecular weight polypropylene, polyolefin copolymer, polyolefin wax, microcrystalline wax, paraffin wax, and Fischer-Tropsch wax), oxides of aliphatic hydrocarbon-based waxes (for example, polyethylene oxide wax and block copolymer of polyethylene oxide wax), plant waxes (for example, candelilla wax, carnauba wax, Japan wax, jojoba wax, and rice wax), animal waxes (for example, beeswax, lanolin, and spermaceti), mineral waxes (for example, ozokerite, ceresin, and petrolatum), waxes having a fatty acid ester as a main component (for example, montanic acid ester wax and castor wax), and waxes containing a partially or fully deoxidized fatty acid ester such as deoxidized carnauba wax.

The additive amount of the releasing agent is preferably at least 1 part by mass and no greater than 30 parts by mass relative to 100 parts by mass of the binder resin, and more preferably at least 5 parts by mass and no greater than 20 parts by mass.

(Colorant)

The toner mother particles 11 may optionally contain a colorant in accordance with necessity thereof. The colorant contained in the toner mother particles 11 can be a known pigment or dye matching the color of the toner particles 10. The following lists specific examples of preferable colorants that may be contained in the toner mother particles 11.

Carbon black can for example be used as a black colorant. Also, a colorant that is adjusted to a black color using colorants such as a yellow colorant, a magenta colorant, and a cyan colorant described below can be used as a black colorant. In a composition in which the toner particles 10 are particles of a color toner, the colorant contained in the toner mother particles 11 may for example be a yellow colorant, a magenta colorant, or a cyan colorant.

Examples of colorants that can be used as the yellow colorant include condensed azo compounds, isoindolinone compounds, anthraquinone compounds, azo metal complexes, methine compounds, and arylamide compounds. Specific examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of colorants that can be used as the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of colorants that can be used as the cyan colorant include copper phthalocyanine compounds, copper phthalocyanine derivatives, anthraquinone compounds, and basic dye lake compounds. Specific examples of the cyan colorant include C.I. Pigment Blue (1, 7, 15, 15:1, 15:2, 15:3, 15:4, 60, 62, and 66), Phthalocyanine Blue, C.I. Vat Blue, and C.I. Acid Blue.

The amount of the colorant contained in the toner mother particles 11 is preferably at least 1 part by mass and no greater than 20 parts by mass relative to 100 parts by mass of the binder resin, and more preferably at least 3 parts by mass and no greater than 10 parts by mass.

(Charge Control Agent)

The toner mother particles 11 may optionally contain a charge control agent in accordance with necessity thereof. The following explains charge control agents that can be contained in the toner mother particles 11.

In the present embodiment, the toner mother particles 11 may contain a positively chargeable charge control agent in order that the toner mother particles 11 are positively chargeable. A charge control agent such as described above is used in order to improve charging stability or a charge rise characteristic of the toner, thereby obtaining a toner having excellent durability or stability. The charge rise characteristic of the toner is an indicator as to whether or not the toner can be charged to a specific charge level in a short period of time.

(Magnetic Powder)

The toner mother particles 11 may optionally contain a magnetic powder in accordance with necessity thereof. Preferable examples of the magnetic powder include ferrite, magnetite, iron, ferromagnetic metals (cobalt and nickel), alloys containing either or both of iron and a ferromagnetic metal, compounds containing either or both of iron and a ferromagnetic metal, ferromagnetic alloys subjected to ferromagnetization such as thermal treatment, and chromium dioxide.

The magnetic powder preferably has a volume median diameter ($D_{50}$) of at least 0.1 μm and no greater than 1.0 μm, and more preferably at least 0.1 μm and no greater than 0.5 μm. The magnetic powder having a volume median diameter ($D_{50}$) in the aforementioned range enables uniform dispersion of the magnetic powder in the binder resin.

In a situation in which the electrostatic latent image developing toner is used as a one component developer, the amount of the magnetic powder is preferably at least 35 parts by mass and no greater than 60 parts by mass relative to 100 parts by mass of the toner overall, and more preferably at least 40 parts by mass and no greater than 60 parts by mass.

<External Additive>

The following explains the external additive 12 according to the present 20 embodiment with reference to the FIGURE. In the electrostatic latent image developing toner according to the present disclosure, the external additive 12 adheres to the surface of the toner mother particles 11.

The external additive 12 includes cores 12*a* and coating layers 12*b* that are each disposed over the surface of a corresponding one of the cores 12*a*.

The external additive 12 preferably has a volume median diameter of at least 0.01 μm and no greater than 1.0 μm. The additive amount of the external additive 12 is preferably at least 0.1 parts by mass and no greater than 2.5 parts by mass relative to 100 parts by mass of the toner mother particles 11, and more preferably at least 0.1 parts by mass and no greater than 2.0 parts by mass. The volume median diameter and the additive amount of the external additive 12 being within the above-described ranges enables improved fluidity and handleability of the toner particles 10.

In the present embodiment, the cores 12*a* are preferably anionic (negatively chargeable) and the coating layers 12*b* are preferably cationic (positively chargeable). The cationic coating layers 12*b* are each disposed over the surface of a corresponding one of the cores 12*a*. Forming cationic coating layers 12*b* over the surface of the cores 12*a* enables charge of the toner to be maintained stably within a desired range of positive charges.

(Cores)

The cores 12*a* of the external additive 12 are preferably silica particles and are more preferably fumed silica.

The surface of the cores 12*a* may be hydrophilically treated using a surface treatment agent. Examples of the aforementioned surface treatment agent include silicon (Si) based surface treatment agents, aluminum (Al) based surface treatment agents, and organic surface treatment agents.

Hydrophilic treatment of the surface of the cores 12*a* facilitates polymerization of the coating layers 12*b*. Therefore, hydrophilic treatment of the surface of the cores 12*a* enables strong adhesion between the cores 12*a* and the coating layers 12*b* and improved charging stability of the toner.

The cores 12*a* of the external additive 12 may be composed solely of silica or may be composed of a combination of two or more substances such as silica and a metal oxide other than silica. Examples of metal oxides other than silica that can be used include alumina, titanium oxide, magnesium oxide, zinc oxide, strontium titanate, and barium titanate. The cores 12*a* being composed solely of silica is preferable in terms of obtaining a toner having excellent fluidity.

(Coating Layers)

The coating layers 12*b* contain a nitrogen-containing resin and a water-soluble positive charge control agent. The coating layers 12*b* enable further stabilization of the charge of the toner in the desired range of positive charges.

The nitrogen-containing resin contained in the coating layers 12*b* has a strong positive chargeability of approximately the same degree in both a high humidity environment (80% RH) and a standard humidity environment (60% RH). The property described above is thought to be due to high hydrophobicity of the nitrogen-containing resin.

The nitrogen-containing resin is a thermosetting resin. Examples of nitrogen-containing resins that can be used include melamine resins, urea resins, phenolic resins, amino resins, polyamide resins, polyimide resins, polyamide-imide resins, aniline resins, guanamine resins, and urethane resins. Among the nitrogen-containing resins listed above, melamine resins and urea resins are preferable.

A melamine resin has a three-dimensional network structure formed through a condensation reaction (cross-linking reaction) between precursors of the melamine resin, and as a result the melamine resin is a thermosetting resin having excellent hardness, water resistance, and heat resistance. Methylol groups of methylol melamine are highly reactive in acidic conditions at high temperatures. The methylol groups undergo a dehydration reaction with hydroxyl groups and thus the surface of a silica particle at which silanol groups are present can be coated through the aforementioned dehydration reaction. Therefore, strong adhesion between the cores 12*a* and the coating layers 12*b* can be maintained over a long period. Also, the melamine resin itself has strong positive chargeability.

Properties of the melamine resin such as described above are commonly shared properties of formaldehyde-based resins (melamine resins, urea resins, and phenolic resins). Among the formaldehyde-based resins listed above, melamine resins are preferable due the relative ease of modification thereof and urea resins are also preferable. A urea resin is for example a polycondensate of urea and formaldehyde. The urea resin can be formed according to the same method as a melamine resin but by using urea in place of melamine. It is more preferable to use a melamine resin for forming the coating layers 12*b* in terms of imparting excellent hardness and positive charging stability.

The water-soluble positive charge control agent is for example a copolymer of a monomer having a positively chargeable functional group and a monomer having a hydroxyl group.

The monomer having the positively chargeable functional group is for example a quaternary ammonium salt having an acryloyl group, a quaternary ammonium salt having a methacryloyl group, or a quaternary ammonium salt having a vinyl group, and is preferably a quaternary ammonium salt having an acryloyl group or a quaternary ammonium salt having a methacryloyl group. Specific examples of quaternary ammonium salts that can be used as the monomer having the positively chargeable functional group include trimethyl-2-methacryloyloxyethylammonium chloride, (3-acrylamidopropyl)trimethylammonium chloride, and trimethylvinylammonium bromide.

The monomer having the hydroxyl group is for example acrylic acid, methacrylic acid, a hydroxyalkyl acrylate, or a hydroxyalkyl methacrylate. Preferable examples of the monomer having the hydroxyl group include hydroxyethyl (meth)acrylates (for example, 2-hydroxyethyl(meth)acrylate), (meth)acrylic acid, and 2-hydroxypropyl(meth)acrylate. The monomer having the hydroxyl group may be used in the form of a salt (for example, a sodium salt). Also, the monomer having the hydroxyl group may have a substituted substituent.

The nitrogen-containing resin preferably constitutes at least 75% by mass and no greater than 98% by mass of the coating layers 12*b*, and more preferably at least 80% by mass and no greater than 96% by mass.

The water-soluble positive charge control agent preferably constitutes at least 2% by mass and no greater than 25% by mass of the coating layers 12*b*, and more preferably at least 4% by mass and no greater than 20% by mass.

The coating layers 12*b* preferably constitute at least 17% by mass and no greater than 80% by mass of the total mass of the cores 12*a* and the coating layers 12*b*. Note that the water-soluble positive charge control agent and the nitrogen-containing resin together constitute up to 100% by mass of the coating layers 12*b*.

<<Toner Manufacturing Method>>

The following explains processes for preparing the toner mother particles 11, preparing the external additive 12, and externally adding the external additive 12 to the toner mother particles 11 in a toner manufacturing method.

Examples of a process for preparing toner mother particles are explained below. The process for preparing toner mother particles is for example preferably a melt-kneading process or an aggregation process.

The melt-kneading process is implemented through steps of mixing, melt-kneading, pulverization, and classification. The mixing step involves mixing a binder resin with one or more other components, such as a colorant, a charge control agent, a releasing agent, and a magnetic powder, to yield a mixture. The melt-kneading step involves melt-kneading of the resultant mixture using a melt-kneading apparatus such as a single or twin screw extruder to yield a melt-kneaded product. The pulverization step involves appropriate cooling to solidify the melt-kneaded product and pulverization of the solidified product according to a commonly known technique to yield a pulverized product. The classification step involves classifying the pulverized product according to a commonly known technique to obtain toner mother particles of a desired particle size.

The aggregation process is implemented through steps of aggregation and coalescence. The aggregation step involves causing particles of a binder resin, a releasing agent, and a colorant to aggregate in an aqueous medium. The subsequently performed coalescence step involves heating the resultant aggregates of particles to cause components of the aggregates to coalesce, thereby yielding toner mother particles.

An example of a process for preparing the external additive 12 is explained below. The external additive 12 can for example be prepared through a reaction process. The following explains the reaction process.

Coating layers 12*b* made of a nitrogen-containing resin and a water-soluble positive charge control agent are formed over the surface of cores 12*a* by causing a reaction (polymerization reaction) of the nitrogen-containing resin and the water-soluble positive charge control agent to occur at the surface of the cores 12*a*. More specifically, monomers or prepolymers of the water-soluble positive charge control agent and the nitrogen-containing resin are caused to react in a medium having the cores 12*a* dispersed therein, thereby forming the coating layers 12*b*, made of the nitrogen-containing resin and the water-soluble positive charge control agent, on the surface of the cores 12*a*. Formation of the coating layers 12*b* through the reaction process helps to ensure that adhesion between the cores 12*a* and the coating layers 12*b* is maintained over a long period. The following provides detailed explanation of the reaction process.

A material of the coating layers 12*b* is added to a liquid dispersion of the cores 12*a*. The resultant dispersion is heated to cause the material of the coating layers 12*b* to react in the dispersion. Next, the dispersion is cooled to room temperature to yield a dispersion containing external additive 12.

In the reaction process, the monomers or prepolymers of the water-soluble positive charge control agent and the nitrogen-containing resin are preferably caused to react (polymerize) in the dispersion containing the cores 12*a* while stirring the dispersion using a stirring apparatus (for example, a HIVIS MIX produced by PRIMIX Corporation).

In a situation in which coating layers 12*b* containing the nitrogen-containing resin and the water-soluble positive charge control agent are to be formed over the surface of silica particles, preferably the dispersion of the cores 12*a* is adjusted to an acidic pH of at least 2 and no greater than 6 prior to formation of the coating layers 12*b*. Adjusting the dispersion of the cores 12*a* to a pH that is acidic relative to neutral can promote formation of the coating layers 12*b*.

The temperature during formation of the coating layers 12*b* is preferably at least 60° C. and no greater than 100° C. The temperature during formation of the coating layers 12*b* being at least 60° C. and no greater than 100° C. can promote formation of the coating layers 12*b*.

Next, solid-liquid separation is performed on the dispersion containing the external additive 12 in order to isolate the external additive 12 from the aforementioned dispersion. The external additive 12 is then washed and dried. Next, the external additive 12 is pulverized to yield a pulverized product. Thus, the external additive 12 is obtained through the process explained above.

Examples of processes for washing, drying, and pulverizing the external additive 12 are described below.

The external additive 12 can be washed using water. The following describes two preferable examples of processes for washing the external additive 12. The first process involves filtering the dispersion of the external additive 12, collecting the external additive 12 as a wet cake, and washing the collected wet cake of the external additive 12 using water. The second process involves causing the external additive 12 to sediment in the dispersion, substituting the supernatant of the dispersion with water, and redispersing the external additive 12 of the dispersion in the water after the substitution.

An example of a process for drying the external additive 12 involves using a dryer (for example, a spray dryer, a fluidized bed dryer, a vacuum freeze dryer, or a reduced pressure dryer). Among the dryers listed above, the spray dryer is preferable in terms that use of the spray dryer makes it easier to inhibit aggregation of the external additive 12 during drying.

After the drying, the resultant powder of aggregated external additive 12 is pulverized. An example of a process for pulverizing the external additive 12 involves using a pulverizer such as a continuous type surface modifier, a jet mill, or a mechanical pulverizer.

Toner particles 10 are prepared by causing the external additive 12 to adhere to the surface of toner mother particles 11. A preferable example of a process for external addition involves mixing the toner mother particles 11 and the external additive 12 using a mixer, such as an FM mixer or a Nauta mixer (registered Japanese trademark), under conditions such that the external additive 12 does not become embedded in the toner mother particles 11.

Examples

The following provides further explanation of the present disclosure through specific Examples. However, note that the present disclosure is of course not limited by the scope of the Examples.

First, examples of synthesis of water-soluble positive charge control agents contained in toners A-1 to A-13 and B-1 to B-5 are explained.

[Synthesis of Water-Soluble Positive Charge Control Agent (Water-Soluble CCR)]

(Water-Soluble CCR-A)

A 1 L separable flask equipped with a stirrer, a condenser, and a thermometer was used as a reaction vessel. First, 20 g of trimethyl-2-methacryloyloxyethylammonium chloride (M0918 produced by Tokyo Chemical Industry Co., Ltd.), 100 g of sodium acrylate (Na-AA produced by Asada Chemical Industry Co., Ltd.), 10 g of 2,2'-azobis(2-methylpropionamidine)dihydrochloride (V-50 produced by Wako Pure Chemical Industries, Ltd.), and 500 g of ion exchanged water were added to the reaction vessel. The reaction vessel was placed in a heating mantle and the contents of the reaction vessel were stirred for one hour at 60° C. to yield a reaction solution. The reaction solution was cooled and was subsequently added to 30 L of ethanol (product of Wako Pure Chemical Industries, Ltd.), thereby yielding an ethanol solution containing a white solid. Solid-liquid separation was performed on the ethanol solution containing the solid by filtering out and drying the solid. Through the above, a trimethyl-2-methacryloyloxyethylammonium chloride-sodium acrylate copolymer (water-soluble CCR-A) was obtained.

(Water-Soluble CCR-B)

A 1 L separable flask equipped with a stirrer, a condenser, and a thermometer was used as a reaction vessel. First, 20 g of (3-acrylamidopropyl)trimethylammonium chloride (A1493 produced by Tokyo Chemical Industry Co., Ltd.), 100 g of hydroxyethyl methacrylate, 10 g of 2,2'-azobis(2-methylpropionamidine)dihydrochloride (V-50 produced by Wako Pure Chemical Industries, Ltd.), and 500 g of ion exchanged water were added to the reaction vessel. The reaction vessel was placed in a heating mantle and the contents of the reaction vessel were stirred for one hour at 60° C. to yield a reaction solution. The reaction solution was cooled and was subsequently added to 30 L of ethanol (product of Wako Pure Chemical Industries, Ltd.), thereby yielding an ethanol solution containing a white solid. Solid-liquid separation was performed on the ethanol solution containing the solid by filtering out and drying the solid. Through the above, (3-acrylamidopropyl)trimethylammonium chloride-hydroxyethyl methacrylate copolymer (water-soluble CCR-B) was obtained.

(Toner A-1)

After dispersing 50 g of water-soluble fumed silica (AEROSIL (registered Japanese trademark) 200 produced by Nippon Aerosil Co., Ltd.) having a specific surface area of 200 $m^2/g$ in 500 mL of ion exchanged water, the pH of the resultant dispersion was adjusted to within a range from pH 3 to 4 through addition of 0.5N hydrochloric acid solution (product of Wako Pure Chemical Industries, Ltd.) to yield an acidic solution. Next, 45 g of a methylol melamine precursor (NIKARESIN (registered Japanese trademark) S-260 produced by Nippon Carbide Industries Co. Inc.), as a melamine resin precursor, and 5 g of the water-soluble CCR-A were mixed with the resultant acidic solution and each of the components was dissolved in the acidic solution to yield a mixed solution. The mixed solution was added into a 1 L separable flask and was left to react for 30 minutes at 70° C. using a thermostatic bath (BK400 produced by Yamato Scientific Co., Ltd.). Through the above, a reaction solution containing a precipitate was obtained. The precipitate-containing reaction solution was filtered to isolate the precipitate. The precipitate was then dried using a thermostatic vacuum drying oven (DP43/63 produced by Yamato Scientific Co., Ltd.) to yield a dried product. The dried product was pulverized using a pulverizer (PJM-80SP produced by Nippon Pneumatic Mfg. Co., Ltd.) to yield an external additive. A small multi-purpose pulverizing mixer (Multi-purpose mixer produced by Nippon Coke & Engineering Co., Ltd.) was used to mix 2 parts by mass of the obtained external additive and 100 parts by mass of a cyan toner (cyan toner for a TASKalfa5550ci produced by KYOCERA Document Solutions Inc.) that had not yet been subjected to external addition. Through the above, toner A-1 was obtained.

(Toner A-2)

Toner A-2 was prepared according to the same process as toner A-1 in all aspects other than that in preparation of the external additive, water-soluble fumed silica (E-220A produced by Tosoh Silica Corporation) having a specific surface area of 150 $m^2/g$ was used instead of the water-soluble fumed silica (AEROSIL (registered Japanese trademark) 200 produced by Nippon Aerosil Co., Ltd.) used in preparation of toner A-1.

(Toner A-3)

Toner A-3 was prepared according to the same process as toner A-1 in all aspects other than that in preparation of the external additive, water-soluble fumed silica (AEROSIL (registered Japanese trademark) 90 produced by Nippon Aerosil Co., Ltd.) having a specific surface area of 90 $m^2/g$ was used instead of the water-soluble fumed silica (AEROSIL (registered Japanese trademark) 200 produced by Nippon Aerosil Co., Ltd.) used in preparation of toner A-1.

(Toner A-4)

Toner A-4 was prepared according to the same process as toner A-1 in all aspects other than that a urea resin precursor (MIRBANE (registered Japanese trademark) resin SU-100 produced by Showa Denko K.K.) was used instead of the melamine resin precursor.

(Toner A-5)

Toner A-5 was prepared according to the same process as toner A-1 in all aspects other than that the water-soluble CCR-B was added instead of the water-soluble CCR-A.

(Toner A-6)

Toner A-6 was prepared according to the same process as toner A-1 in all aspects other than that the additive amount of the water-soluble CCR-A was 10 g instead of 5 g and the additive amount of the melamine resin precursor was 40 g instead of 45 g.

(Toner A-7)

Toner A-7 was prepared according to the same process as toner A-1 in all aspects other than that 10 g of the water-soluble CCR-B was added instead of 5 g of the water-soluble CCR-A and the additive amount of the melamine resin precursor was 40 g instead of 45 g.

(Toner A-8)

Toner A-8 was prepared according to the same process as toner A-1 in all aspects other than that the additive amount of the water-soluble CCR-A was 2 g instead of 5 g and the additive amount of the melamine resin precursor was 48 g instead of 45 g.

(Toner A-9)

Toner A-9 was prepared according to the same process as toner A-1 in all aspects other than that 2 g of the water-soluble CCR-B was added instead of 5 g of the water-soluble CCR-A and the additive amount of the melamine resin precursor was 48 g instead of 45 g.

(Toner A-10)

Toner A-10 was prepared according to the same process as toner A-1 in all aspects other than that the additive amount of the water-soluble CCR-A was 1 g instead of 5 g and the additive amount of the melamine resin precursor was 9 g instead of 45 g.

(Toner A-11)

Toner A-11 was prepared according to the same process as toner A-1 in all aspects other than that 1 g of the water-soluble CCR-B was added instead of 5 g of the water-soluble CCR-A and the additive amount of the melamine resin precursor was 9 g instead of 45 g.

(Toner A-12)

Toner A-12 was prepared according to the same process as toner A-1 in all aspects other than that the additive amount of the water-soluble CCR-A was 20 g instead of 5 g and the additive amount of the melamine resin precursor was 180 g instead of 45 g.

(Toner A-13)

Toner A-13 was prepared according to the same process as toner A-1 in all aspects other than that 20 g of the water-soluble CCR-B was added instead of 5 g of the water-soluble CCR-A and the additive amount of the melamine resin precursor was 180 g instead of 45 g.

(Toner B-1)

Toner B-1 was prepared according to the same process as toner A-1 in all aspects other than that the surface of the hydrophilic fumed silica, used as the external additive, was not covered by a coating layer.

(Toner B-2)

Toner B-2 was prepared according to the same process as toner A-1 in all aspects other than that 5 g of 3-aminopropyltriethoxysilane was added instead of 5 g of the water-soluble CCR-A and the melamine resin precursor was not added.

(Toner B-3)

Toner B-3 was prepared according to the same process as toner A-1 in all aspects other than that the melamine resin precursor was not added.

(Toner B-4)

Toner B-4 was prepared according to the same process as toner A-1 in all aspects other than that the water-soluble CCR-A was not added and the additive amount of the melamine resin precursor was 50 g instead of 45 g.

(Toner B-5)

Toner B-5 was prepared according to the same process as toner A-1 in all aspects other than that a styrene-acrylic copolymer charge control agent (FCA-201-PS produced by Fujikura Kasei Co., Ltd.) was added instead of the water-soluble CCR-A of the external additive (including coating layers and silica particles as cores).

Table 1 shows details of the types and additive amounts of materials contained in the cores and the coating layers of the external additives used in toners A-1 to A-13 and B-1 to B-5.

TABLE 1

| | Cores (silica particles) | | Coating layers | | | | | |
|---|---|---|---|---|---|---|---|---|
| Toner | Product name | Additive amount [g] | Product name | Additive amount [g] | Product name | Additive amount [g] | Proportion of coating layers constituted by water-soluble CCR [% by mass] | Proportion of external additive constituted by coating layers [% by mass] |
| A-1 | AEROSIL 200 | 50 | NIKARESIN S-260 | 45 | CCR-A | 5 | 10 | 50 |
| A-2 | E-220A | 50 | NIKARESIN S-260 | 45 | CCR-A | 5 | 10 | 50 |
| A-3 | AEROSIL 90 | 50 | NIKARESIN S-260 | 45 | CCR-A | 5 | 10 | 50 |
| A-4 | AEROSIL 200 | 50 | MIRBANE resin SU-100 | 45 | CCR-A | 5 | 10 | 50 |
| A-5 | AEROSIL 200 | 50 | NIKARESIN S-260 | 45 | CCR-B | 5 | 10 | 50 |
| A-6 | AEROSIL 200 | 50 | NIKARESIN S-260 | 40 | CCR-A | 10 | 20 | 50 |
| A-7 | AEROSIL 200 | 50 | NIKARESIN S-260 | 40 | CCR-B | 10 | 20 | 50 |
| A-8 | AEROSIL 200 | 50 | NIKARESIN S-260 | 48 | CCR-A | 2 | 4 | 50 |
| A-9 | AEROSIL 200 | 50 | NIKARESIN S-260 | 48 | CCR-B | 2 | 4 | 50 |
| A-10 | AEROSIL 200 | 50 | NIKARESIN S-260 | 9 | CCR-A | 1 | 10 | 17 |
| A-11 | AEROSIL 200 | 50 | NIKARESIN S-260 | 9 | CCR-B | 1 | 10 | 17 |
| A-12 | AEROSIL 200 | 50 | NIKARESIN S-260 | 180 | CCR-A | 20 | 10 | 80 |
| A-13 | AEROSIL 200 | 50 | NIKARESIN S-260 | 180 | CCR-B | 20 | 10 | 80 |
| B-1 | AEROSIL 200 | 50 | — | — | — | — | — | — |
| B-2 | AEROSIL 200 | 50 | — | — | 3-Amino propyl triethoxy silane | 5 | — | — |
| B-3 | AEROSIL 200 | 50 | — | — | CCR-A | 5 | — | — |
| B-4 | AEROSIL 200 | 50 | NIKARESIN S-260 | 50 | — | — | — | 50 |
| B-5 | AEROSIL 200 | 50 | NIKARESIN S-260 | 45 | FCA-201-PS | 5 | — | 50 |

[Evaluation Method]

Toners A-1 to A-13 and B-1 to B-5 were evaluated according to the method described below.

<Method of Preparing Developer for Evaluation>

A carrier (carrier for TASKalfa5550ci produced by KYOCERA Document Solutions Inc.) and 10% by mass of toner relative to the mass of the carrier were added into a mixer and mixed for 30 minutes to prepare a developer (two component developer) for evaluation. A ball mill (NT-1S produced by Tech-Jam) was used as the mixer.

(Environment-Dependence of Charge)

For each of the toner A-1 to A-13 and B-1 to B-5, samples of a developer prepared for evaluation using the toner were left for 24 hours under two different sets of environmental conditions; environment N (24° C. and 60% RH) corresponding to standard temperature and standard humidity conditions and environment H (32° C. and 80% RH) corresponding to high temperature and high humidity conditions. After exposure to the environment for 24 hours, the charge of the toner in each of the developer samples was measured using a portable charge measurement device that uses a "draw off" method (MODEL 212HS produced by Trek, Inc.). The charge of the toner exposed to environment H and the charge of the toner exposed to environment N were used to calculate a ratio of environment-dependent change according to the expression shown below.

Ratio of environment-dependent change=(charge of toner in environment *H*)/(charge of toner in environment *N*)

In a situation in which the charge of the toner in environment N was less than 20 μC/g, the charge of the toner in environment N was judged to be poor, and in a situation in which the charge of the toner in environment N was at least 20 μC/g and less than 30 μC/g, the charge of the toner in environment N was judged to be good. In a situation in which the charge of the toner in environment N was at least 30 μC/g and less than 40 μC/g, the charge of the toner in environment N was judged to be very good, and in a situation in which the charge of the toner in environment N was at least 40 μC/g, the charge of the toner in environment N was judged to be especially good. A ratio of environment-dependent change of less than 0.6 was judged to be poor because a value of less than 0.6 indicates that the toner cannot favorably maintain charge in the environment H. A ratio of environmental change of at least 0.6 and less than 0.8 was judged to be good because a value of at least 0.6 and less than 0.8 indicates that the toner can favorably maintain charge in the environment H. A ratio of environment-dependent change of at least 0.8 was judged to be especially good because a value of at least 0.8 indicates that the toner can especially favorably maintain charge in the environment H.

(Printing Durability)

A color multifunction peripheral (TASKalfa5550ci produced by KYOCERA Document Solutions Inc.) was used as an evaluation apparatus. For each of toners A-1 to A-13 and B-1 to B-5, a developer prepared using the toner was added into a cyan development section of the evaluation apparatus and toner for replenishment use was added into a cyan toner container of the evaluation apparatus. The evaluation apparatus was used to print 5,000 sheets with a coverage of 1% under environmental conditions of 24° C. and 60% RH. After 5,000 sheets had been printed, the evaluation apparatus was used to output a sample image including a solid image. Image density of the solid image included in the sample image and fogging density were evaluated as described below.

(Method of Measuring Fogging Density and Image Density)

Image density (ID) and fogging density (FD) were measured using a reflection densitometer (R710 produced by Ihara Corporation). The image density (ID) is an image density value for a printed-on (i.e. covered) section of a recording medium after a printing durability test has been performed. Fogging density is a value calculated as shown in the expression below by subtracting image density of a recording medium on which printing has not been performed from image density of a blank portion of a recording medium after a printing durability test has been performed.

Fogging density=(image density of blank portion of recording medium after printing durability test)−(image density of recording medium prior to printing)

Image quality was judged to be poor in a situation in which image density was less than 1.1 or fogging density was at least 0.01, and image quality was judged to be good in a situation in which image density was at least 1.1 and fogging density was less than 0.01.

(Replenishment Fogging)

Once printing durability had been evaluated using a specific evaluation pattern having a coverage of 1%, a specific evaluation pattern having a coverage of 10% was printed on 15 sheets and fogging density was measured with respect to each of the printed sheets. A largest value among the measured values for fogging density was taken as an evaluation value. Note that when printing with a high coverage commences after a long period of time printing with a low coverage, there is an increase in the amount of new toner (i.e., toner that has not undergone stress and that does not have low chargeability) that is used for replenishment of the developing device.

In the evaluation of replenishment fogging, a fogging density of at least 0.01 was evaluated as poor and a fogging density of less than 0.01 was evaluated as good.

Table 2 shows, for each of toners A-1 to A-13 and B-1 to B-5, charge after exposure to the aforementioned environments, ratio of environment-dependent change, printing durability evaluation, and replenishment fogging after printing with a coverage of 10%.

TABLE 2

| Toner | Charge after exposure to environment: 24° C., 60% RH, 24 h (environment N) [μC/g] | Charge after exposure to environment: 32° C., 80% RH, 24 h (environment H) [μC/g] | Ratio of environment-dependent change (Environment H)/(Environment N) | Printing durability evaluation (after printing 5,000 sheets with 1% coverage): Image density (ID) | Printing durability evaluation (after printing 5,000 sheets with 1% coverage): Fogging density (FD) | Replenishment fogging after printing with 10% coverage (FD) |
|---|---|---|---|---|---|---|
| A-1 | 33.9 | 27.5 | 0.81 | 1.35 | 0.002 | 0.005 |
| A-2 | 35.1 | 27.4 | 0.78 | 1.29 | 0.003 | 0.005 |
| A-3 | 34.4 | 26.8 | 0.78 | 1.22 | 0.003 | 0.007 |
| A-4 | 27.8 | 20.6 | 0.74 | 1.22 | 0.004 | 0.008 |
| A-5 | 35.7 | 30.0 | 0.84 | 1.28 | 0.002 | 0.005 |
| A-6 | 38.8 | 29.5 | 0.76 | 1.39 | 0.007 | 0.006 |
| A-7 | 41.0 | 31.6 | 0.77 | 1.36 | 0.005 | 0.004 |
| A-8 | 22.8 | 18.2 | 0.80 | 1.28 | 0.009 | 0.006 |
| A-9 | 23.0 | 18.6 | 0.81 | 1.29 | 0.007 | 0.008 |
| A-10 | 20.3 | 15.8 | 0.78 | 1.35 | 0.008 | 0.005 |
| A-11 | 20.8 | 16.8 | 0.81 | 1.28 | 0.006 | 0.004 |
| A-12 | 30.8 | 22.8 | 0.74 | 1.18 | 0.003 | 0.006 |
| A-13 | 31.4 | 22.9 | 0.73 | 1.14 | 0.004 | 0.004 |
| B-1 | 7.2 | 4.3 | 0.60 | 1.27 | 0.020 | 0.028 |
| B-2 | 44.8 | 24.2 | 0.54 | 1.20 | 0.002 | 0.042 |
| B-3 | 41.6 | 13.6 | 0.33 | 0.57 | 0.042 | 0.051 |
| B-4 | 14.3 | 12.2 | 0.85 | 1.37 | 0.016 | 0.002 |
| B-5 | 15.2 | 10.4 | 0.68 | 1.24 | 0.011 | 0.003 |

The electrostatic latent image developing toners according to the present disclosure had excellent properties in terms of charge after environmental exposure and ratio of environment-dependent change. The electrostatic latent image developing toners according to the present disclosure also had excellent properties in terms of printing durability and replenishment fogging after printing with 10% coverage. Therefore, the electrostatic latent image developing toners according to the present disclosure clearly have excellent charging stability and high durability over a long period.

What is claimed is:

1. An electrostatic latent image developing toner comprising a plurality of toner particles that each include a toner mother particle and an external additive, wherein the external additive includes cores and coating layers that are each disposed over a surface of a corresponding one of the cores, the cores contain silica, the coating layers contain a nitrogen-containing resin and a water-soluble positive charge control agent, the nitrogen-containing resin is a thermosetting resin, and the water-soluble positive charge control agent is a copolymer of a quaternary ammonium salt having an acryloyl group or a quaternary ammonium salt having a methacryloyl group and acrylic acid, methacrylic acid, a hydroxyalkyl acrylate, or a hydroxyalkyl methacrylate.

2. An electrostatic latent image developing toner according to claim 1, wherein the coating layers constitute at least 17% by mass and no greater than 80% by mass of a total mass of the coating layers and the cores.

3. An electrostatic latent image developing toner according to claim 1, wherein the water-soluble positive charge control agent constitutes at least 4% by mass and no greater than 20% by mass of the coating layers, and the nitrogen-containing resin constitutes at least 80% by mass and no greater than 96% by mass of the coating layers, such that the water-soluble positive charge control agent and the nitrogen-containing resin together constitute up to 100% by mass of the coating layers.

4. An electrostatic latent image developing toner according to claim 1, wherein each of the plurality of toner particles further includes a shell layer disposed over a surface of the toner mother particle.

* * * * *